US010468831B2

(12) United States Patent
Zhao

(10) Patent No.: US 10,468,831 B2
(45) Date of Patent: Nov. 5, 2019

(54) ELECTRICAL CONNECTOR HAVING TWO ROWS OF CONTACTS EACH CONSISTING OF ONE GROUND CONTACT AND ONE POWER CONTACT

(71) Applicant: FOXCONN INTERCONNECT TECHNOLOGY LIMITED, Grand Cayman (KY)

(72) Inventor: Jun Zhao, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/873,159

(22) Filed: Jan. 17, 2018

(65) Prior Publication Data

US 2018/0205186 A1 Jul. 19, 2018

(30) Foreign Application Priority Data

Jan. 17, 2017 (CN) ..... 2017 2 0060126 U

(51) Int. Cl.

| | |
|---|---|
| ***H01R 9/03*** | (2006.01) |
| ***H01R 13/6594*** | (2011.01) |
| ***H01R 12/71*** | (2011.01) |
| ***H01R 13/502*** | (2006.01) |
| ***H01R 24/62*** | (2011.01) |
| ***H01R 13/26*** | (2006.01) |
| ***H01R 13/64*** | (2006.01) |
| *H01R 12/70* | (2011.01) |
| *H01R 13/6582* | (2011.01) |
| *H01R 107/00* | (2006.01) |

(Continued)

(52) U.S. Cl.

CPC ..... *H01R 13/6594* (2013.01); *H01R 12/712* (2013.01); *H01R 13/26* (2013.01); *H01R 13/502* (2013.01); *H01R 13/64* (2013.01); *H01R 24/62* (2013.01); *H01R 12/707* (2013.01); *H01R 12/722* (2013.01); *H01R 13/6582* (2013.01); *H01R 24/60* (2013.01); *H01R 2107/00* (2013.01)

(58) Field of Classification Search

CPC .. H01R 13/6594; H01R 12/712; H01R 13/26; H01R 13/502; H01R 13/64; H01R 24/62; H01R 12/722

USPC ..... 439/607.01, 607.34, 607.35

See application file for complete search history.

(56) References Cited

U.S. PATENT DOCUMENTS

| | | | | |
|---|---|---|---|---|
| 9,478,905 | B2 | 10/2016 | Golko | |
| 2015/0303623 | A1* | 10/2015 | Kao | H01R 13/6583 439/607.04 |

(Continued)

FOREIGN PATENT DOCUMENTS

| | | |
|---|---|---|
| CN | 203859265 | 10/2014 |
| CN | 105680246 | 6/2016 |

*Primary Examiner* — Khiem M Nguyen

(74) *Attorney, Agent, or Firm* — Wei Te Chung; Ming Chieh Chang

(57) ABSTRACT

An electrical connector includes: an insulative housing having a base and a tongue; an upper and lower rows of contacts secured in the insulative housing and exposed to two opposite surfaces of the tongue; a pair of grounding pieces separated from each other and mounted in the insulative housing between the upper row of contacts and the lower row of contacts; a shielding shell enclosing the insulative housing, wherein each row of the upper and lower rows of contacts consist of one outermost ground contact and one power contact.

8 Claims, 11 Drawing Sheets

(51) Int. Cl.
*H01R 12/72* (2011.01)
*H01R 24/60* (2011.01)

(56) References Cited

U.S. PATENT DOCUMENTS

2015/0333451 A1* 11/2015 Kao ..... H01R 24/60
439/607.01
2015/0340798 A1* 11/2015 Kao ..... H01R 13/516
439/660
2015/0364871 A1* 12/2015 Lin ..... H01R 13/6581
439/607.58
2016/0006195 A1* 1/2016 Zhao ..... H01R 13/405
439/676
2016/0372870 A1 12/2016 Guo
2017/0201048 A1 7/2017 Kong

* cited by examiner

| A1 | A2 | A3 | A4 | A5 | A6 | A7 | A8 | A9 | A10 | A11 | A12 |
|---|---|---|---|---|---|---|---|---|---|---|---|
| GND | | | Vbus | | | | | | | | |
| | | | | | | | | | | | |
| | | | | | | | | Vbus | | | GND |
| B12 | B11 | B10 | B9 | B8 | B7 | B6 | B5 | B4 | B3 | B2 | B1 |

FIG. 8

ELECTRICAL CONNECTOR HAVING TWO ROWS OF CONTACTS EACH CONSISTING OF ONE GROUND CONTACT AND ONE POWER CONTACT

BACKGROUND OF THE INVENTION

1. Field of the Invention

The present invention relates to an electrical connector having two rows of contacts and a pair of separated grounding pieces between the two rows of contacts, wherein each row of the two rows of contacts consist of one ground contact and one power contact for ease of manufacturing at low cost for specific applications such as for charging purposes only.

2. Description of Related Arts

China Patent No. 203859265 discloses an electrical connector supporting dual-orientation mating, comprising an upper and lower rows of contacts, wherein each row of the two rows of contacts include two outermost ground contacts and two power contacts.

China Patent Application Publication No. 105680246 discloses a dual-orientation electrical connector comprising two rows of contacts and a pair of grounding pieces separated from each other between the two rows of contacts. Each row of contacts need not be full-fledged, as is known in this art, e.g., in U.S. Patent Application Publication No. 2016/0372870.

SUMMARY OF THE INVENTION

An electrical connector comprises: an insulative housing having a base and a tongue; an upper and lower rows of contacts secured in the insulative housing and exposed to two opposite surfaces of the tongue; a pair of grounding pieces separated from each other and mounted in the insulative housing between the upper row of contacts and the lower row of contacts; a shielding shell enclosing the insulative housing, wherein each row of the upper and lower rows of contacts consist of one outermost ground contact and one power contact.

BRIEF DESCRIPTION OF THE DRAWING

FIG. 8 is a schematic table showing contact positions of the electrical connector.

DETAILED DESCRIPTION OF THE PREFERRED EMBODIMENT

Figure 1:
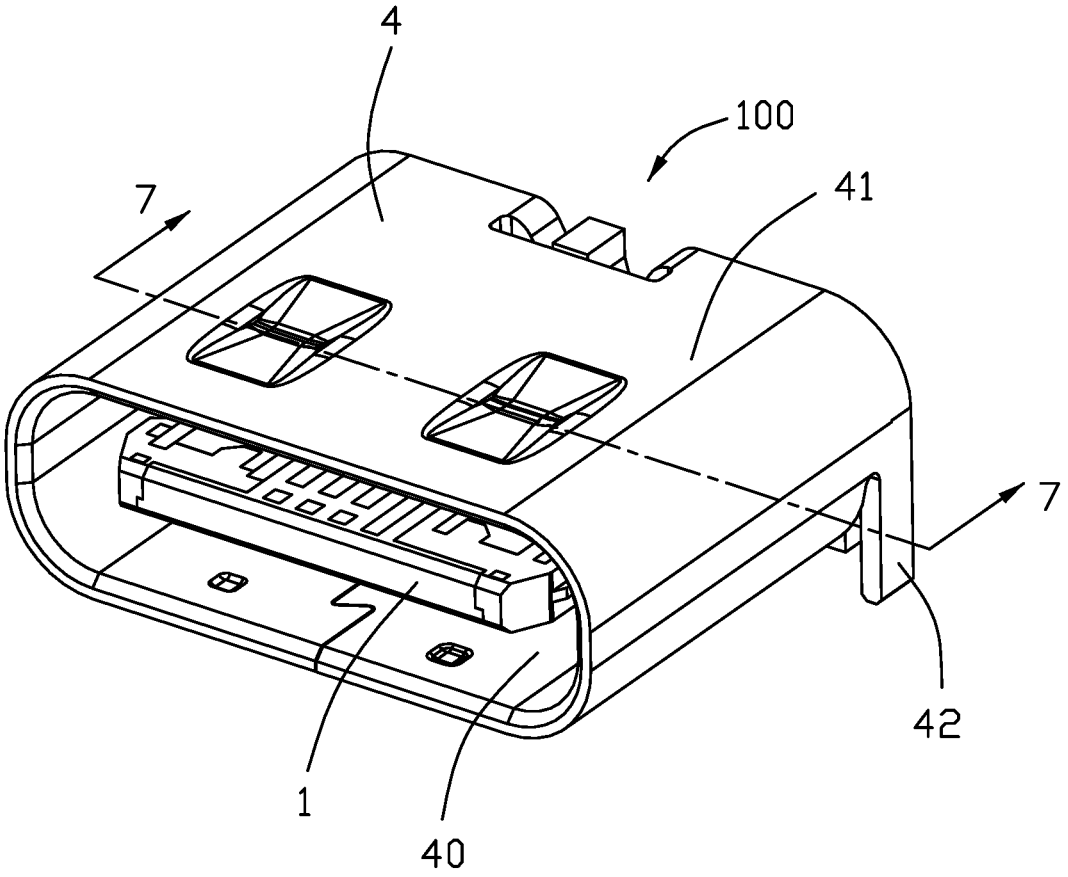
FIG. 1 is a front perspective view of an electrical connector in accordance with the present invention.
Figure 2:
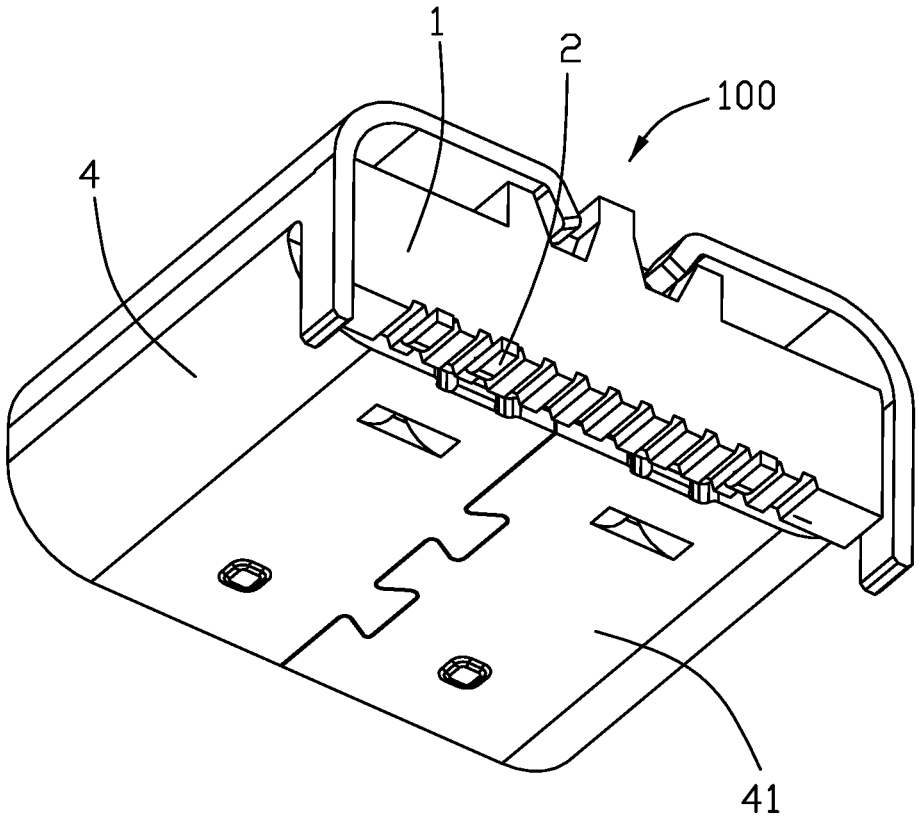
FIG. 2 is a rear perspective view of the electrical connector.
Figure 3:
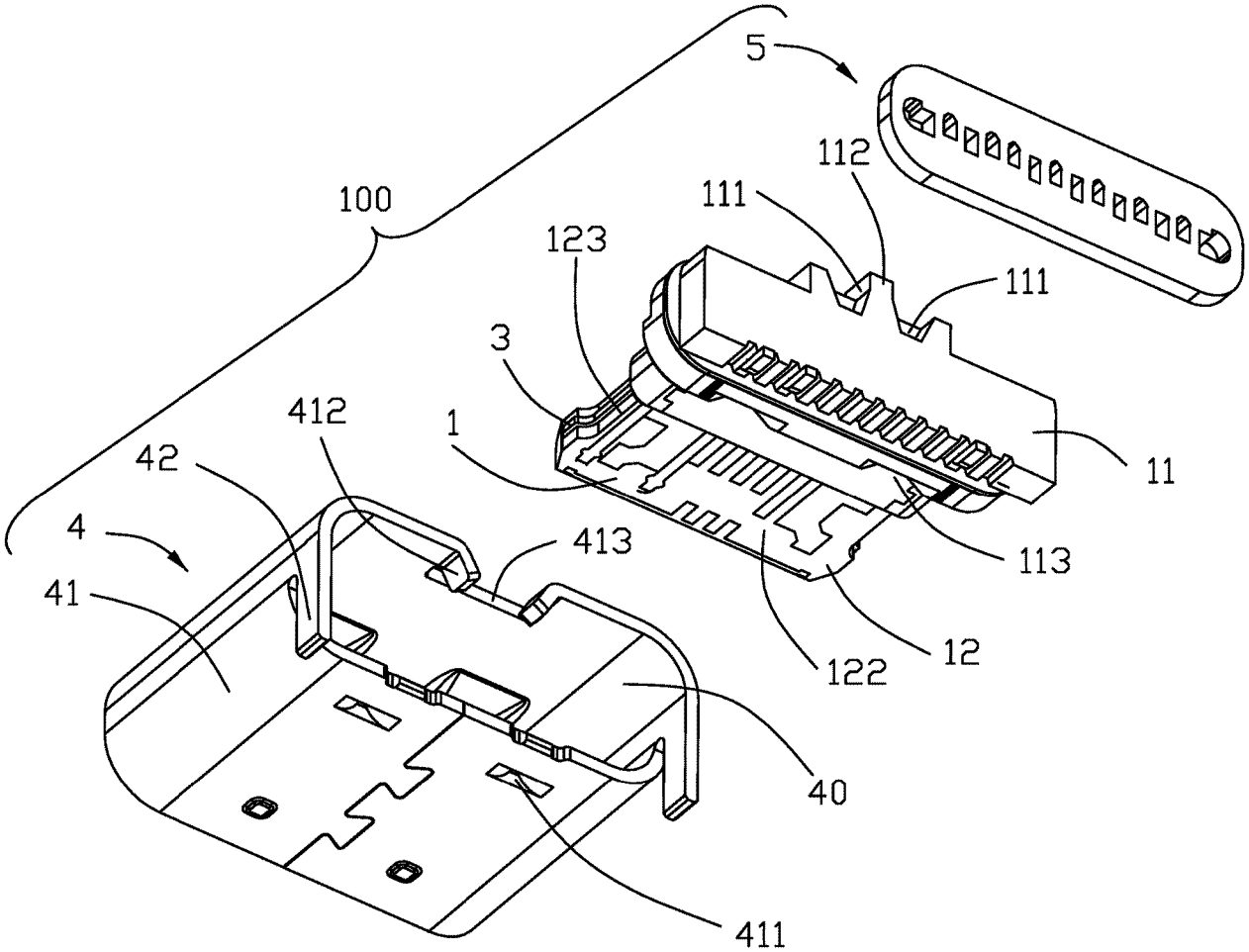
FIG. 3 is an exploded view of the electrical connector.
Figure 4:
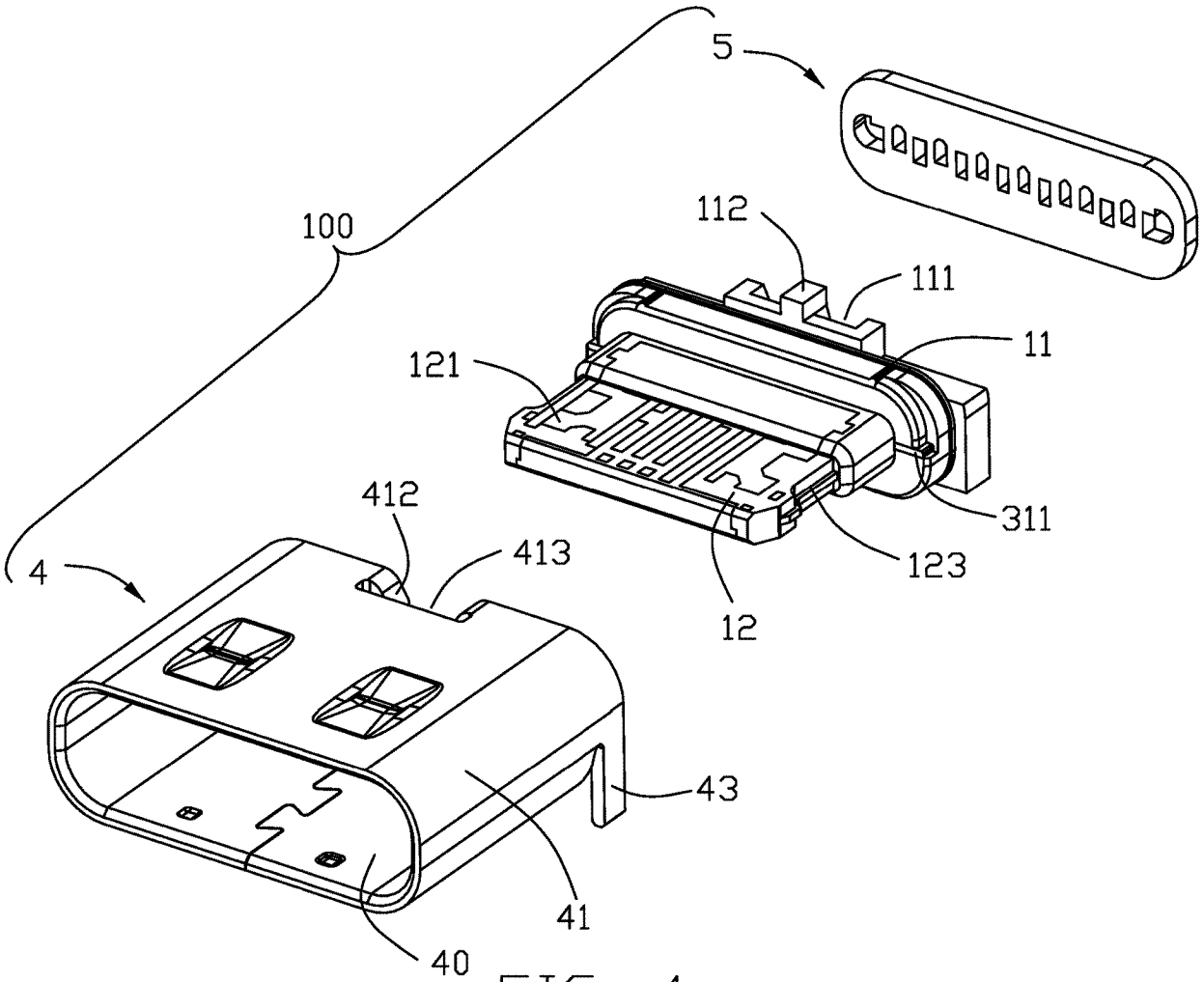
FIG. 4 is an exploded view from a different perspective.
Figure 4A:
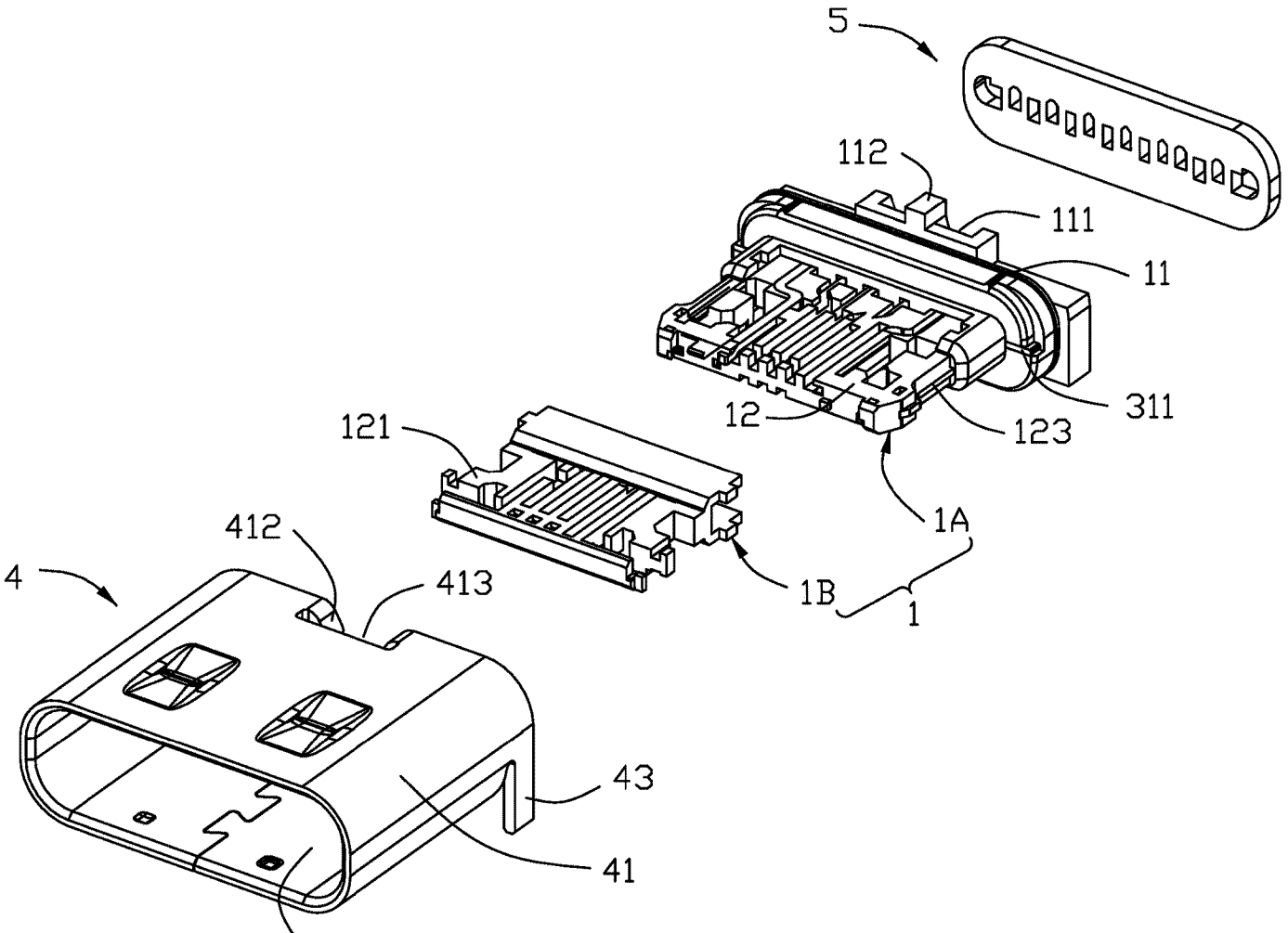
FIG. 4(A) is a further exploded perspective view of the electrical connector of FIG. 4 to show the second stage housing is adapted to be applied upon the first stage housing to form the complete housing.

Referring to FIGS. 1 to 8, an electrical connector 100 comprises an insulative housing 1, two rows of contacts 2 secured in the insulative housing 1, a pair of grounding/locking pieces 3 separated from each other and mounted in the insulative housing 1 between the two rows of contacts 2, and a shielding shell 4 having a receiving space 40 and enclosing the insulative housing 1. The insulative housing 1, the contacts 2, and the grounding pieces 3 constitute a contact module.

Referring to FIGS. 2-5, the insulative housing 1 has a base 11 and a tongue 12. The base 11 has a pair of rear slots 111, a protrusion 112, and a pair of front slots 113. The tongue 12 has opposite first and second mating surfaces 121 and 122 facing away from each other in the vertical direction, and a pair of side notches 123.

Figure 7:
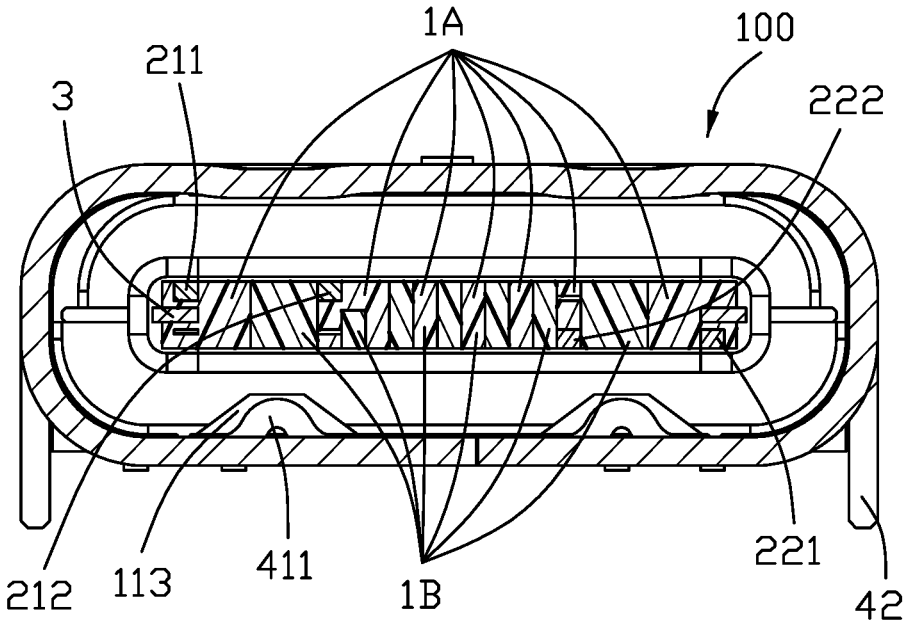
FIG. 7 is a cross-sectional view of the electrical connector taken along line A-A in FIG. 1.
Figure 7A:
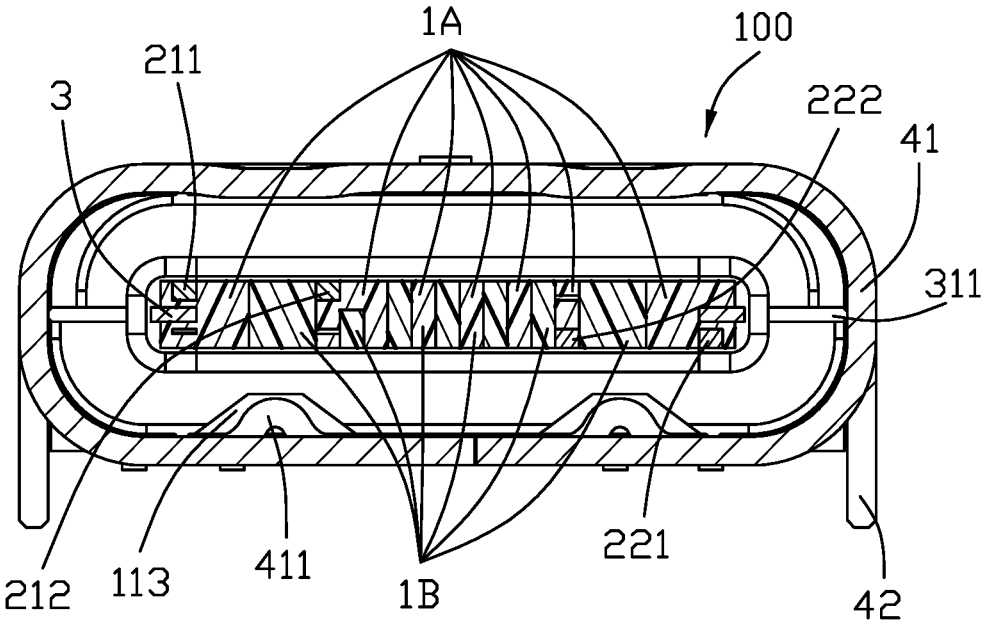
FIG. 7(A) is a cross-sectional view of the electrical connector of FIG. 1 wherein the shielding shell is in contact with the pair of grounding pieces in an alternate embodiment.

Referring to FIGS. 5-8, the contacts 2 include an upper row of contacts 21 and a lower row of contacts 22. Each row of the upper and lower rows of contacts 21 and 22 consist of one outermost ground contact and one power contact, i.e., retaining only two (2) contacts (the first contact and the fourth contact) out of a total of twelve contacts in conformity with USB Type-C standard while omitting the other ten (10) contacts. Each contact 2 has a contacting portion 23 exposed upon the corresponding first or second mating surface 121. 122 of the tongue 12, a soldering portion 25, and an intermediate connecting portion 24. The soldering portions 25 of the upper and lower contacts 21 and 22 are aligned in one line. The upper row of contacts 21 consist of one outermost ground contact 211 and one power contact 212 next to and inwardly of the ground contact 211; the lower row of contacts 22 consist of one outermost ground contact 221 and one power contact 222 next to and inwardly of the ground contact 221. The one grounding contact 211 and the one power contact 212 in one row are reversely symmetrical with regard to another grounding contact 211 and another power contact 212 in the other row. A distance between the contacting portions 23 of the ground contact 211 and the power contact 212 is greater than a distance between the connecting portions 24 thereof for large current conduction. Notably, each grounding piece 3 is aligned with only one grounding contact 211 in the vertical direction, as shown in FIGS. 7 and 7(A).

Figure 5:
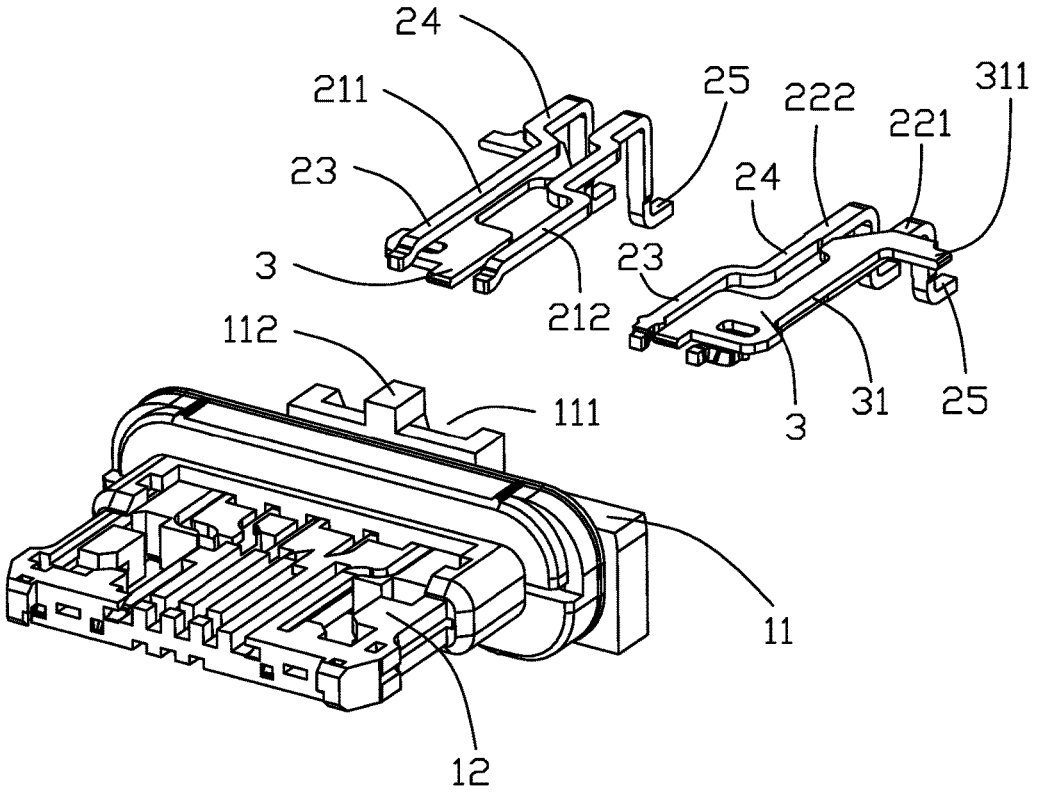
FIG. 5 is an exploded view showing part of a contact module of the electrical connector.
Figure 5A:
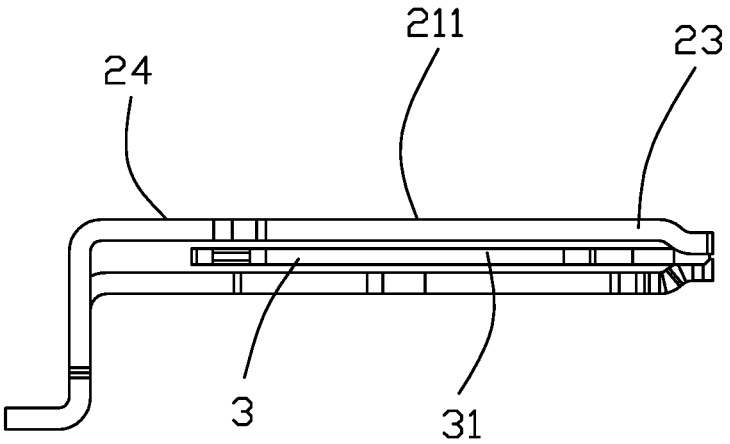
FIG. 5(A) is a side view of the contacts of the electrical connector of FIG. 5 wherein the grounding contact is in contact with the corresponding grounding piece in an alternate embodiment.
Figure 6:
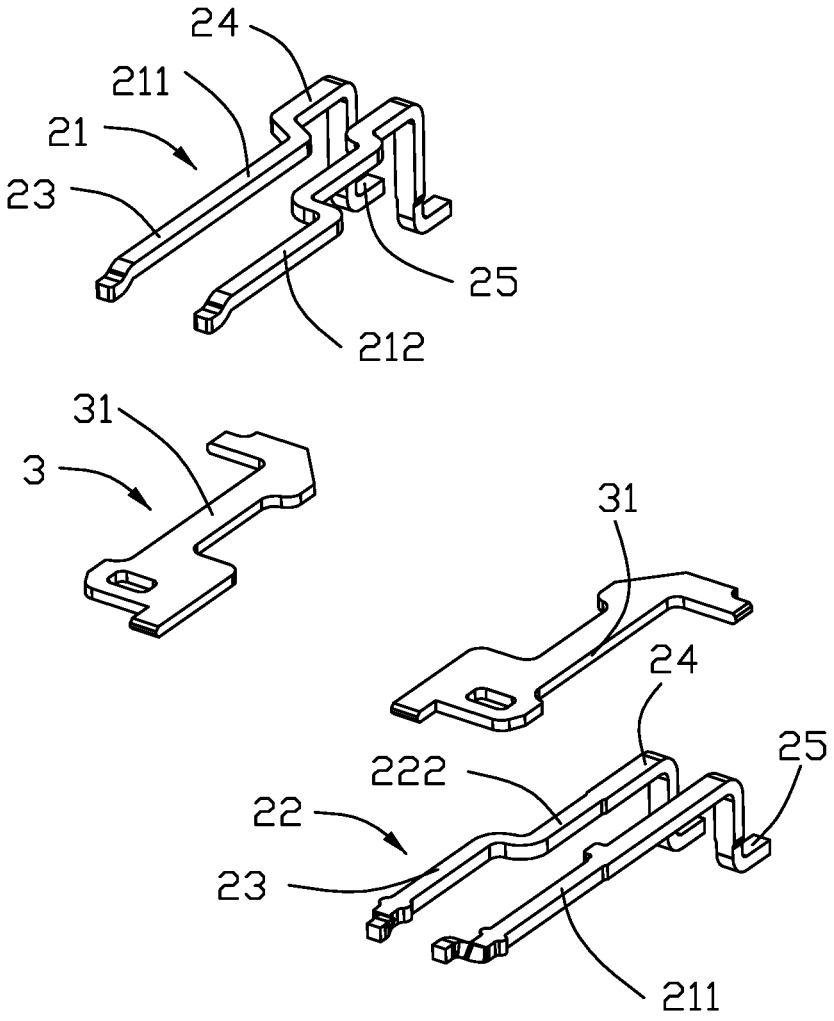
FIG. 6 is an exploded view showing an upper and lower rows of contacts and a pair of grounding pieces of the contact module of the electrical connector.

Referring again to FIG. 5, the pair of grounding/locking pieces 3 are insert molded together with the contacts 2 simultaneously in one shot. The grounding piece 3 has a side portion 31 exposed to the notch 123. The grounding piece 3 may have a portion 311 in contact with an inner wall of the shielding shell 4 as shown in FIG. 7(A). Or, the grounding piece 3 may be in contact with a corresponding ground contact 211 or 221 as shown in FIG. 5(A).

Referring to FIGS. 1-8, the shielding shell 4 has a main part 41, a pair of front stops 411 at a bottom wall of the main part 41, a pair of rear stops 412, and a limiting slot 413, and a pair of soldering legs 42. Notably, in the invention the contacts 2 and the grounding pieces 3 are both integrally formed with the first stage housing 1A via an initial/single insert-molding process, and successively further integrally formed within a second stage housing 1B via another insert-molding or overmolding process to complete the complete configuration of the housing 1, as shown in FIGS. 4, 4(A) and FIGS. 7, 7(A).

What is claimed is:

1. An electrical connector comprising:

an insulative housing having a base and a tongue;

an upper and lower rows of contacts secured in the insulative housing and exposed to two opposite surfaces of the tongue;

a pair of grounding pieces separated from each other and mounted in the insulative housing between the upper row of contacts and the lower row of contacts;

a shielding shell enclosing the insulative housing; wherein each row of the upper and lower rows of contacts consist only of one outermost ground contact and one power contact out of a total of twelve contact positions in conformity with USB Type-C standard.

2. The electrical connector as claimed in claim 1, wherein all the contacts and the grounding pieces are insert molded simultaneously.

3. An electrical connector comprising:

a contact module enclosed within a metallic shielding shell and including a plurality of contacts arranged in two rows, a pair of metallic grounding/locking pieces located between the two rows in a vertical direction, all said contacts and said pair of grounding/locking pieces being integrally formed within an insulative housing via an initial single shot insert-molding process, said housing including a base and a tongue portion extending forwardly from the base along a front-to-back direction perpendicular to said vertical direction, wherein said contacts include only one pair of grounding contacts at opposite outermost positions in a transverse direction perpendicular to both said vertical direction and said front-to-back direction, and only one pair of power contacts located at opposite inner positions between said pair of grounding contacts in the transverse direction; wherein each row has one grounding contact and one power contact which are both located on a same side with regard to a front-to-back centerline of the housing; and said contacts only include said pair of grounding contacts and said pair of power contacts out of a total of twenty-four contact positions in conformity with USB Type-C standard.

4. An electrical connector comprising:

a contact module enclosed within a metallic shielding shell and including a plurality of contacts arranged in two rows, a pair of metallic grounding/locking pieces located between the two rows in a vertical direction, all said contacts and the pair of grounding/locking pieces being integrally formed within an insulative housing via insert-molding, said housing including a base and a tongue portion extending forwardly from the base along a front-to-back direction perpendicular to said vertical direction, said tongue portion defining opposite mating surfaces facing away from each other in the vertical direction, wherein each of said contacts including a contacting portion exposed upon one of said opposite mating surfaces of the tongue portion;

said contacts include only one pair of grounding contacts at opposite outermost positions in a transverse direction perpendicular to both said vertical direction and said front-to-back direction, and only one pair of power contacts located at opposite inner positions between said pair of grounding contacts in the transverse direction; wherein each row only has one grounding contact and one power contact which are both located on a same side with regard to a front-to-back centerline of the housing so that the one grounding contact and the one power contact in one row are reversely symmetrical with regard to another grounding contact and another power contact in the other row; wherein the grounding/locking piece is aligned with only one corresponding grounding contact in said vertical direction.

5. The electrical connector as claimed in claim 4, wherein all said contacts and said pair of grounding/locking pieces are integrally formed within an insulative first stage housing via an initial insert-molding process and successively integrally formed within an insulative second stage housing via another insert-molding process, and said insulative first stage housing and said insulative second stage housing commonly form said whole housing.

6. The electrical connector as claimed in claim 4, wherein an amount of all said contacts is four.

7. The electrical connector as claimed in claim 4, wherein the shielding shell is in contact with the pair of grounding/locking pieces.

8. The electrical connector as claimed in claim 4, wherein each ground contact is in contact with a corresponding grounding/locking piece.

* * * * *